US012070078B2

(12) United States Patent
Qiu et al.

(10) Patent No.: US 12,070,078 B2
(45) Date of Patent: Aug. 27, 2024

(54) METHOD AND DEVICE FOR CONTROLLING ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Wanlin Cai, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 561 days.

(21) Appl. No.: 17/370,088

(22) Filed: Jul. 8, 2021

(65) Prior Publication Data

US 2021/0401060 A1 Dec. 30, 2021

Related U.S. Application Data

(63) Continuation-in-part of application No. PCT/CN2020/071064, filed on Jan. 9, 2020.

(30) Foreign Application Priority Data

Jan. 9, 2019 (CN) ..... 201910019096.9

(51) Int. Cl.
*A24F 40/53* (2020.01)
*A24F 40/46* (2020.01)
(Continued)

(52) U.S. Cl.
CPC ..... *A24F 40/53* (2020.01); *A24F 40/46* (2020.01); *A24F 40/57* (2020.01); *A24F 40/60* (2020.01)

(58) Field of Classification Search
CPC ..... A24F 40/53; A24F 40/46; A24F 40/57; A24F 40/60
(Continued)

(56) References Cited

U.S. PATENT DOCUMENTS 10,973,258 B2 * 4/2021 Alarcon ..... G16H 40/63
11,641,881 B2 * 5/2023 Qiu ..... A24F 40/50 131/329
(Continued)

FOREIGN PATENT DOCUMENTS

CN 203660013 U 6/2014
CN 204032371 U 12/2014
(Continued)

OTHER PUBLICATIONS

International search report of PCT patent application No. PCT/CN2020/071064 issued on Apr. 15, 2020.
(Continued)

*Primary Examiner* — Gary F Paumen
(74) *Attorney, Agent, or Firm* — Andrew C. Cheng

(57) ABSTRACT

A method and a device for controlling electronic cigarette belong to the technical field of computers. The method comprises: when a safety mode of electronic cigarette is turned on, if a cigarette lighting signal is detected, using a detection component to detect whether an atomizing head is moved out of an electronic cigarette body; if detecting that the atomizing head is moved out of the electronic cigarette body, stopping controlling the atomizing head to work according to the cigarette lighting signal, wherein when the atomizing head is moved out of the electronic cigarette body, the atomizing head is still electrically connected to battery assembly in the electronic cigarette. The method and the device solve the problem that electronic cigarette user mistakenly triggers lighting operation and causes to burn user when the atomizing head is exposed outside the electronic cigarette body, which achieving safe use effect of electronic cigarette.

20 Claims, 4 Drawing Sheets

(51) Int. Cl.
*A24F 40/57* (2020.01)
*A24F 40/60* (2020.01)

(58) Field of Classification Search
USPC ..... 131/329
See application file for complete search history.

(56) References Cited

U.S. PATENT DOCUMENTS

2013/0284194 A1* 10/2013 Newton ..... A24F 40/40 131/329
2014/0083443 A1* 3/2014 Liu ..... A24F 40/95 320/107
2014/0299138 A1* 10/2014 Xiang ..... A24F 40/53 340/309.16
2014/0305450 A1* 10/2014 Xiang ..... A24F 40/65 700/266
2014/0366894 A1* 12/2014 Liu ..... A24F 40/60 131/328
2015/0075545 A1* 3/2015 Xiang ..... A24F 40/53 429/61
2015/0173124 A1* 6/2015 Qiu ..... A24F 40/60 131/328
2015/0173419 A1* 6/2015 Tu ..... A24F 40/51 131/329
2015/0173421 A1 6/2015 Hsieh
2015/0216235 A1* 8/2015 Liu ..... A24F 40/51 131/329
2015/0237915 A1* 8/2015 Liu ..... A24F 40/485 131/329
2015/0351456 A1* 12/2015 Johnson ..... A24F 40/30 131/329
2015/0357839 A1* 12/2015 Cai ..... H02J 7/00714 131/329
2016/0021930 A1* 1/2016 Minskoff ..... A24F 40/51 392/395
2016/0029698 A1* 2/2016 Xiang ..... A24F 40/65 131/328
2016/0073693 A1* 3/2016 Reevell ..... A24F 40/50 131/329
2016/0106155 A1* 4/2016 Reevell ..... H05B 1/0297 131/329
2018/0289060 A1* 10/2018 Chen ..... A24F 40/50
2018/0289063 A1* 10/2018 Mo ..... H05B 3/44
2018/0343924 A1* 12/2018 Lin ..... F16K 31/004
2018/0360115 A1* 12/2018 Lin ..... A24F 40/53

FOREIGN PATENT DOCUMENTS

CN 104256898 A 1/2015
CN 106579563 A 4/2017
CN 107510097 A 12/2017
CN 107772543 A 3/2018
CN 107951084 A 4/2018
CN 207613192 U 7/2018
CN 108851240 A 11/2018
CN 109007975 A 12/2018
CN 209420955 U 9/2019

OTHER PUBLICATIONS

Office Action with Search Report of CN patent application No. 201910019096.9 issued on Nov. 25, 2020.

* cited by examiner

METHOD AND DEVICE FOR CONTROLLING ELECTRONIC CIGARETTE

TECHNICAL FIELD

The present invention relates to the field of simulation smoking technologies, and in particular, to a method and a device for controlling an electronic cigarette.

BACKGROUND

As a substitute of tobacco products, an electronic cigarette is more and more popular on the market because of its safety, convenience, health, and environmental protection.

Atomizing heads of some electronic cigarettes are arranged on a movable bottom cover. When user moves the movable bottom cover out of an electronic cigarette body, he can add aerosols into the electronic cigarette body to form base material. After adding aerosols, user need install the movable bottom cover into the electronic cigarette body, then user can use the electronic cigarette for suction.

However, when the movable bottom cover moves out of the electronic cigarette body, if electronic cigarette ignition key is mistakenly triggered, the atomizing head works and heats, and the atomizing head is exposed to the electronic cigarette body, which is easy to burn user.

SUMMARY

In order to solve the problem that the electronic cigarette user mistakenly triggers lighting operation and causes to burn user when the atomizing head is exposed outside the electronic cigarette body, an embodiment of the present invention provides a method and a device for controlling an electronic cigarette. The technical solution is as follows:

In a first aspect, a method for controlling the electronic cigarette is provided. The method includes:

when a safety mode of the electronic cigarette is turned on, if a cigarette lighting signal is detected, using a detection component to detect whether an atomizing head is moved out of an electronic cigarette body;

if detecting that the atomizing head is moved out of the electronic cigarette body, stopping controlling the atomizing head to work according to a cigarette lighting signal, wherein when the atomizing head is moved out of the electronic cigarette body, the atomizing head is still electrically connected to a battery assembly in the electronic cigarette.

Optionally, the atomizing head of the electronic cigarette is arranged on a movable bottom cover, the movable bottom cover is rotationally connected to the electronic cigarette body, when the movable bottom cover is closed, it moves into the electronic cigarette body, when the movable bottom cover is opened, it moves out of the electronic cigarette body, the detection component includes a hall switch and a magnetic part, wherein, the magnetic part is arranged on the movable bottom cover, and the hall switch is arranged in the electronic cigarette body, when the movable bottom cover drives the atomizing head to move into the electronic cigarette body, the hall switch is located above the magnetic part; or the hall switch is arranged on the movable bottom cover, the magnetic part is arranged in the electronic cigarette body, when the movable bottom cover drives the atomizing head to move into the electronic cigarette body, the magnetic part is located above the hall switch.

Optionally, the method further includes:

when the electronic cigarette is in a standby state and a main menu display signal is detected, displaying a main menu, which includes safety mode menu item;

when the safety mode menu item is detected to be selected, displaying a first setting interface for setting a switch state in a safety mode.

Optionally, before the step of displaying the main menu, further includes:

after the electronic cigarette is turned on, entering a standby mode and displaying a temperature selection interface;

if an adjustment signal is detected during displaying the temperature selection interface, obtaining a selected temperature in the temperature selection interface according to the adjustment signal, which can be operation signal generated when an increase key or an decrease key on the electronic cigarette is operated, during displaying the temperature selection interface, if detecting main menu display signal generated by operating an electronic cigarette on/off key, implementing the step of displaying the main menu.

Optionally, the main menu also includes at least one of heating mode menu item, temperature measurement unit menu item and screen brightness menu item, the method further includes:

when detecting that the heating mode menu item is selected, displaying a mode selection interface for selecting a heating mode, which includes the heating mode matched with at least one type of atomizing head supported by the electronic cigarette; and/or when detecting that the temperature measurement unit menu item is selected, displaying a second setting interface for setting the temperature measurement unit in the electronic cigarette; and/or when detecting that the screen brightness menu item is selected, displaying a third setting interface for setting brightness of the electronic cigarette display screen.

Optionally, further includes:

when detecting that the atomizing head is changed in the electronic cigarette, the detection component is used to detect whether the atomizing head is moved into the electronic cigarette body;

when detecting that the atomizing head is moved into the electronic cigarette body, displaying the mode selection interface for selecting the heating mode;

obtaining selected heating mode in the mode selection interface;

the electronic cigarette controlling the atomizing head to work according to the cigarette lighting signal, comprises: the electronic cigarette controlling the atomizing head to work according to heating rule corresponding to the selected heating mode.

Optionally, after the step of obtaining the selected heating mode in the mode selection interface, further includes:

displaying the temperature selection interface to obtain the selected heating temperature;

the electronic cigarette controlling the atomizing head to work according to the heating rule corresponding to the selected heating mode, comprises: obtaining the heating rule according to the selected heating mode and the selected heating temperature, and the electronic cigarette controlling the atomizing head to work according to the heating rule.

Optionally, after the step of using the detection component to detect whether the atomizing head is moved out of the electronic cigarette body, further includes:

if detecting that the atomizing head is moved out of the electronic cigarette body, obtaining reference information, which includes at least one of time interval from end time of previous cigarette lighting operation, temperature of the atomizing head, and resistance value of the atomizing head;

if determining existing scalding risk according to the reference information, displaying prompt information to prompt the existing scalding risk.

In a second aspect, a computer readable storage medium is provided. The computer readable storage medium stores therein one or more instructions, when the one or more instructions are executed by a processor in an electronic cigarette, the method for controlling the electronic cigarette according to the first aspect and any one of the embodiments of the first aspect is implemented.

In a third aspect, a device for controlling the electronic cigarette is provided. The device includes:

a memory and a processor;

the memory storing at least one program instruction;

the processor loading and executing the at least one program instruction to implement the method for controlling the electronic cigarette according to the first aspect and any one of the embodiments of the first aspect.

The beneficial effects brought by the technical solutions provided by the embodiments of the present invention are as follows:

When the safety mode of the electronic cigarette is turned on and if the cigarette lighting signal is detected, using a detection component to detect whether an atomizing head is moved out of an electronic cigarette body; if detecting that the atomizing head is moved out of the electronic cigarette body, stopping controlling the atomizing head to work according to the cigarette lighting signal. It solves the problem that electronic cigarette user mistakenly triggers lighting operation and causes to burn user when the atomizing head is exposed outside the electronic cigarette body, which achieving safe use effect of electronic cigarette.

BRIEF DESCRIPTION OF THE DRAWINGS

In order to more clearly illustrate the technical solutions in the embodiments of the present invention, the drawings used in the description of the embodiments will be briefly described below. It is obvious that the drawings in the following description are only some embodiments of the present invention. For those of ordinary skill in the art, other drawings may also be obtained in light of these drawings without any creative efforts.

DETAILED DESCRIPTION OF PREFERRED EMBODIMENTS

The embodiments of the present invention will be further described in detail below with reference to the accompanying drawings. The "electronic devices" mentioned in the description may include smart phones, tablets, smart TVs, e-book readers, MP3 players (Moving Picture Experts Group Audio Layer III), MP4 (Moving Picture Experts Group Audio Layer IV) players, laptops and desktop computers, or the like.

Figure 1:
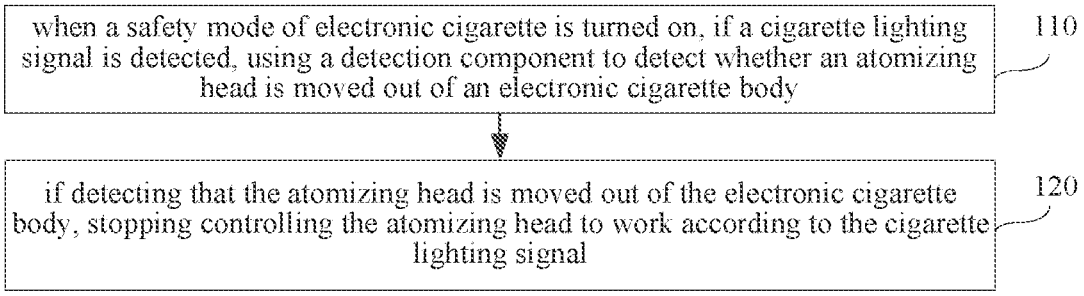
FIG. 1 is a flowchart of a method for controlling an electronic cigarette according to an embodiment of the present invention.

FIG. 1 is a flowchart of a method for controlling an electronic cigarette according to an embodiment of the present invention. Referring to FIG. 1, the method for controlling an electronic cigarette can include:

Step 110, when a safety mode of an electronic cigarette is turned on, if a cigarette lighting signal is detected, using a detection component to detect whether an atomizing head is moved out of an electronic cigarette body.

Optionally, the cigarette lighting signal may be an operation signal generated by operating the electronic cigarette on/off key.

Figure 2:
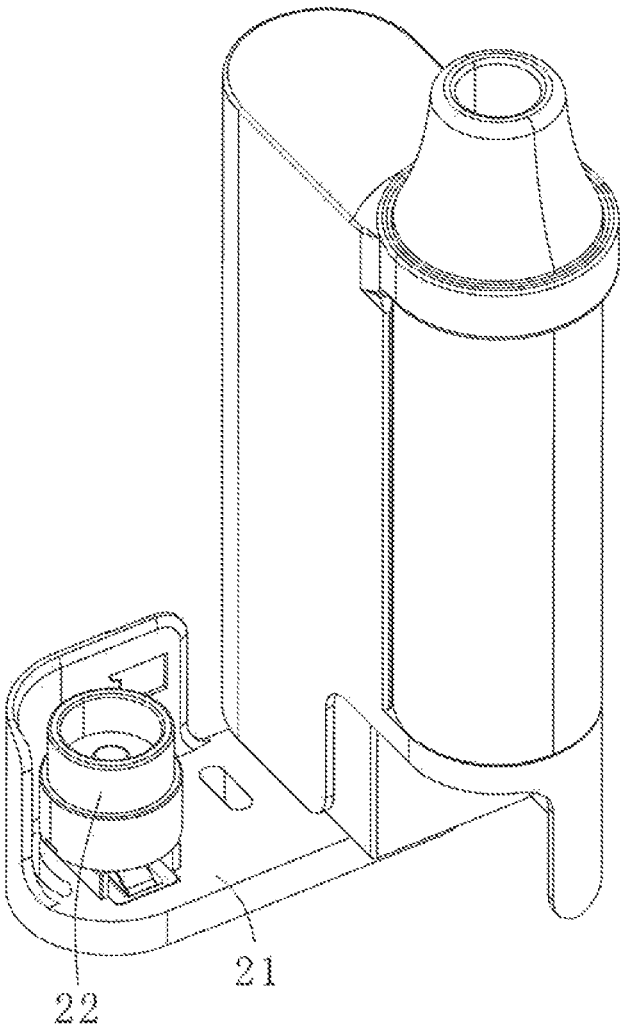
FIG. 2 is a schematic diagram of the electronic cigarette structure according to an embodiment of the present invention.

Optionally, referring to FIG. 2, the atomizing head 22 of the electronic cigarette is arranged on movable bottom cover 21, and the user can move the atomizing head 22 into or out of the electronic cigarette body by operating the movable bottom cover 21. It should be noted that when the atomizing head 22 is moved into the electronic cigarette body, the atomizing head 22 is electrically connected to battery assembly in the electronic cigarette. When the electronic cigarette detects the cigarette lighting signal, the battery assembly can be controlled to supply power to the atomizing head 22, so that the atomizing head 22 is electrified and heated. By operating the movable bottom cover 21, the atomizing head 22 is moved out of the electronic cigarette body without changing circuit connection between the atomizing head 22 and the battery assembly. The atomizing head 22 is still electrically connected to the battery assembly in the electronic cigarette, and the electronic cigarette can still control the battery assembly to supply power to the atomizing head 22, so that the atomizing head 22 is electrified and heated. However, when the atomizing head 22 is moved out of the electronic cigarette body, the atomizing head 22 is electrified and heated, which may scald the user. Therefore, a safety mode is set in the embodiment of the invention.

Optionally, the movable bottom cover is rotationally connected to the electronic cigarette body. When the movable bottom cover is closed, it moves into the electronic cigarette body. When the movable bottom cover is opened, it moves out of the electronic cigarette body. When the electronic cigarette user needs to change the atomizing head of the electronic cigarette, he can open the movable bottom cover 21 to move the movable bottom cover 21 out of the electronic cigarette body, and then change the atomizing head on the movable bottom cover 21. After finishing changing the atomizing head, the movable bottom cover 21 is closed to move into the electronic cigarette body.

The electronic cigarette user can turn on or turn off the safety mode of the detection component by operating the electronic cigarette. The detection component is for detecting whether the atomizing head is removed out of the electronic cigarette. The detection component includes a hall switch and a magnetic part, and the hall switch is electrically connected to an electronic cigarette inner processor.

In one embodiment, the magnetic part is arranged on the movable bottom cover, and the hall switch is arranged in the electronic cigarette body. When the movable bottom cover drives the atomizing head to move into the electronic cigarette body, the hall switch is located above the magnetic part. In another embodiment, the hall switch is arranged on the movable bottom cover, the magnetic part is arranged in the electronic cigarette body, when the movable bottom cover drives the atomizing head to move into the electronic cigarette body, the magnetic part is located above the hall switch.

Wherein, if the movable bottom cover moves out of the electronic cigarette body, the hall switch cannot detect magnetism, and the hall switch is turned off, the electronic cigarette can detect that the hall switch is turned off, and determine that the atomizing head is moved out of the electronic cigarette body. If the movable bottom cover is in the electronic cigarette body, the hall switch can detect magnetism, and the hall switch is turned on, the electronic cigarette can detect that the hall switch is turned on, and determine that the atomizing head was not moved out of the electronic cigarette body.

The application is only illustrated by an example of the detection component including a hall switch and a magnetic part. In actual implementation, the detection component can include an infrared transmitter, and an infrared receiver, or the detection component is a distance sensor set on side wall of the electronic cigarette body and for detecting distance between the electronic cigarette body and the movable bottom cover, which is not limited in this embodiment.

Step 120, if detecting that the atomizing head is moved out of the electronic cigarette body, stopping controlling the atomizing head to work according to the cigarette lighting signal.

Alternatively, after step 110, if detecting that the atomizing head is not moved out of the electronic cigarette body, controlling the atomizing head to work according to the cigarette lighting signal to atomize base material in the electronic cigarette to generate smoke.

In conclusion, the method provided by the embodiment of the invention can realize: when the safety mode of the electronic cigarette is turned on and if the cigarette lighting signal is detected, using a detection component to detect whether an atomizing head is moved out of an electronic cigarette body; if detecting that the atomizing head is moved out of the electronic cigarette body, stopping controlling the atomizing head to work according to the cigarette lighting signal. It solves the problem that an electronic cigarette user mistakenly triggers lighting operation and causes to burn the user when the atomizing head is exposed outside the electronic cigarette body, which achieving safe use effect of the electronic cigarette.

Optionally, when the safety mode of the electronic cigarette is turned off and the cigarette lighting signal is detected, controlling the atomizing head to work according to the cigarette lighting signal to base material in the electronic cigarette to generate smoke.

Optionally, if user moves the atomizing head out of the electronic cigarette body in a short time while smoking, it is also easy to burn the user. Therefore, when the electronic cigarette also detects that the atomizing head is moved out of the electronic cigarette body, obtaining reference information, which includes at least one of time interval from end time of previous cigarette lighting operation, temperature of the atomizing head, and resistance value of the atomizing head. If determining existing scalding risk according to the reference information, displaying prompt information to prompt the existing scalding risk.

Optionally, the prompt information can include any of text, voice, vibration, indicator light, etc.

Optionally, determining whether existing scalding risk according to the reference information may include:

First, the reference information includes time interval from end time of previous cigarette lighting operation. If the time interval is less than a preset time, determining existing scalding risk; the preset time can be time period required for the atomizing head to cool down to temperature of non-scalding at the end time of previous cigarette lighting operation.

Second, the reference information includes temperature of the atomizing head. If the temperature of the atomizing head reaches a preset temperature, determining existing scalding risk, and the preset temperature can be the lowest temperature that can scald user skin.

Third, the reference information includes resistance value of the atomizing head. If the resistance value of the atomizing head reaches a preset resistance value, determining existing scalding risk, and the preset resistance value can be the resistance value when the atomizing head reaches the lowest temperature that can scald user skin.

A first setting interface for setting a switch state in a safety mode corresponding to the detection component can be provided in the electronic cigarette of the application, one of which can be provided in the following way: when the electronic cigarette is in a standby state and main menu display signal is detected, displaying the main menu, which includes safety mode menu item. When the safety mode menu item is detected to be selected, displaying a first setting interface for setting a switch state in a safety mode corresponding to the detection component.

Among them, the main menu display signal can be operation signal generated by operation of confirmation key when the electronic cigarette is in the standby state, or operation signal generated by continuously short pressing on/off key when the electronic cigarette is in the standby state. Optionally, the electronic cigarette will enter the standby mode after being turned on.

Figure 3:
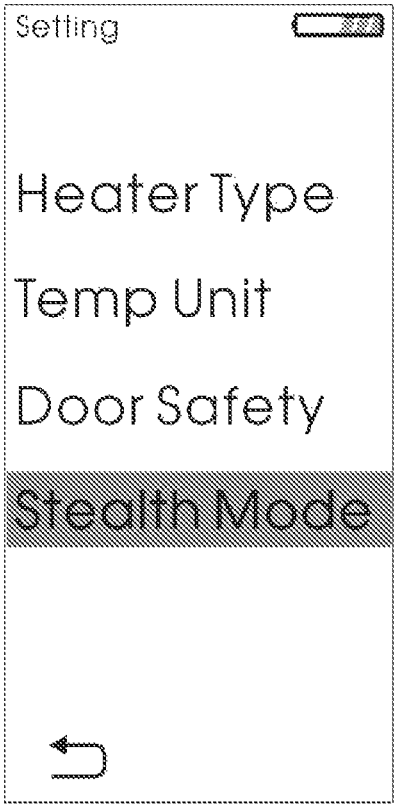
FIG. 3 is a schematic diagram of a main menu display interface of the electronic cigarette according to an embodiment of the present invention.

For example, user can continuously press the on/off key for 5 times to turn on the electronic cigarette. When the electronic cigarette is turned on, a home screen is displayed, and then it will enter the standby state. If the on/off key is detected to be continuously pressed for 3 times or the confirmation key is detected to be short pressed for one time, the display interface of the main menu as shown in FIG. 3 will be displayed. The main menu includes a safety mode menu item (Door Safety option as shown in FIG. 3), a heating mode menu item (Heater Type option as shown in FIG. 3), a temperature measurement unit menu item (Temp Unit option as shown in FIG. 3), and a screen brightness menu item (Stealth Mode option as shown in FIG. 3). The user can adjust the position of the cursor 31 in the display interface by operating the increase key and the decrease key of the electronic cigarette. When a press signal corresponding to the confirmation key is detected, obtaining the option of the cursor position as selected option.

Figure 4:
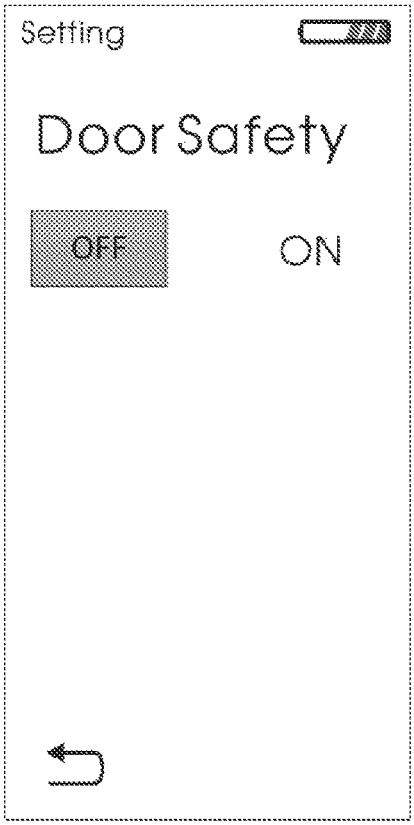
FIG. 4 is a schematic diagram of a first setting interface for setting a switch state in a safety mode corresponding to a detection component according to an embodiment of the present invention.

For another example, when the electronic cigarette detects that the safety mode menu item is selected, as shown in FIG. 4, displaying the first setting interface for setting the switch state in the safety mode corresponding to the detection component, the off button(OFF) and the on button(ON) can be displayed in the first setting interface. The user can adjust the position of the cursor 31 in the display interface by operating the increase key and the decrease key of the electronic cigarette. When the press signal corresponding to the confirmation key is detected, obtaining the button of the cursor position. If the button is an off button, turning off the safety mode corresponding to the detection component. If the button is an on button, turning on the safety mode corresponding to the detection component.

Optionally, the main menu provided by the electronic cigarette also includes at least one of heating mode menu item, temperature measurement unit menu item and screen brightness menu item. When detecting that the heating mode menu item is selected, displaying a mode selection interface for selecting the heating mode, which includes a heating mode matched with at least one type of atomizing head supported by the electronic cigarette. When detecting that the temperature measurement unit menu item is selected, displaying a second setting interface for setting the temperature measurement unit in the electronic cigarette. When detecting that the screen brightness menu item is selected, displaying a third setting interface for setting brightness of the electronic cigarette display screen.

Figure 5:
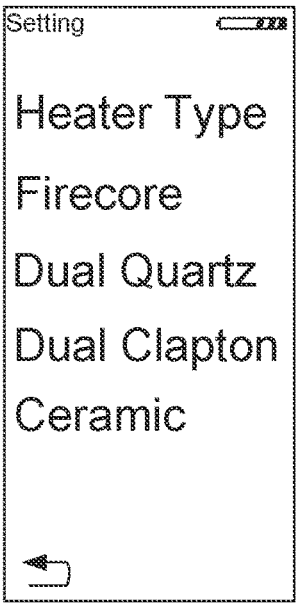
FIG. 5 is a schematic diagram of a mode selection interface for selecting a heating mode according to an embodiment of the present invention.

The application is illustrated by the electronic cigarette supporting at least one of glass heating wire, double ordinary wire, double stranded wire and ceramic heating wire. For example, when detecting that the heating mode menu item is selected, displaying the mode selection interface for selecting the heating mode. As shown in FIG. 5, the mode selection interface includes a Firecore mode corresponding to the glass heating wire, a Dual Quartz mode corresponding to the double ordinary wire, a Dual Clapton mode corresponding to the double twisted wire and a Ceramic mode corresponding to the ceramic heating wire.

If obtaining the heating mode selected by the user in the mode selection interface of the electronic cigarette, controlling the atomizing head to work according to a heating rule corresponding to the selected heating mode. Among them, there are different heating rules corresponding to the heating modes in the electronic cigarette.

Optionally, if obtaining the heating mode selected by the user in the mode selection interface of the electronic cigarette, displaying a temperature selection interface to obtain the selected heating temperature. The electronic cigarette controls the atomizing head to work according to the lighting signal, further includes: obtaining the heating rule according to the selected heating mode and the selected heating temperature, and the electronic cigarette controlling the atomizing head to work according to the heating rule.

In one example, the temperature selection interface provides many preset temperatures for selection, and the heating rules corresponding to each preset temperature under each heating mode are stored in the electronic cigarette. For example, the electronic cigarette user selects the Ceramic mode in the mode selection interface as shown in FIG. 5, and the temperature selection interface can include three preset temperatures, namely 900° F., 1000° F. and 1100° F.; if the electronic cigarette user selects 1000° F., the electronic cigarette obtains the heating rule corresponding to 1000° F. in the Ceramic mode. When the cigarette lighting signal is detected, the electronic cigarette heats according to the heating rule.

Optionally, the heating rule of the heating mode corresponding to the glass heating wire can include: heating with a preset heating power; when the heating time period of one time heating reaches a target heating time period, keeping the temperature with a preset insulation power. Relationship between the target heating time period and the preset temperature selected by the user accords with a formula $$t1 = \frac{(T1 - T2) * c * m}{a * P},$$

wherein, t1 is the target heating time period, T1 is the preset temperature selected by the user. T2 is an initial heating temperature, P is a preset heating power, a is a preset coefficient, C is a specific heat capacity, and M is a mass of the heating wire.

Optionally, the heating rules of the electronic cigarette for the heating mode corresponding to the double ordinary wire, the double stranded wire, and the ceramic heating wire can include: before the resistance value of the heating wire reaches the target resistance value, controlling the heating wire to heat to increase the heating wire temperature. When the resistance value of the heating wire reaches the target resistance value, keeping temperature, and the target resistance value is the resistance value of the heating wire at the temperature selected by the user. The relationship between the resistance value of each heating wire and its temperature can be stored in the electronic cigarette in form of tables or curves.

Due to different materials of the double ordinary wire, the double stranded wire and the ceramic heating wire, temperature control curves (resistance temperature curves) are different, which results in that the heating rules corresponding to the same preset temperature in the same mode are not identical. However, the method of controlling the heating wire to heat to increase the heating wire temperature is not limited in the invention, can be realized in other ways, and further details are not provided herein again.

The selected heating mode of the electronic cigarette should match with type of the atomizing head in the electronic cigarette. Optionally, when detecting that the atomizing head is changed in the electronic cigarette, the detection component is used to detect whether the atomizing head is moved into the electronic cigarette body. When detecting that the atomizing head is moved into the electronic cigarette body, displaying the mode selection interface for selecting the heating mode, so that the user can reselect the heating mode to ensure that the heating mode of the electronic cigarette matches with type of the atomizing head in the electronic cigarette.

Among them, detecting whether the atomizing head is changed can include as follows: a load access circuit is set in the electronic cigarette, when the atomizing head is installed in the electronic cigarette body, and can be electrically connected to the load access circuit, a processor detects that the atomizing head is moved out via the load access circuit, and determines that the atomizing head is changed, and other methods of detecting whether the atomizing head is changed will not be described here.

Optionally, before displaying the mode selection interface, displaying the prompt information which prompts that the atomizing head is changed. The displaying prompt information method can be any one of text prompt, voice prompt, animation prompt, etc. For example, displaying the text prompt "Atomizing Head Detected" in the display screen.

Optionally, when the electronic cigarette is turned on, the home screen is displayed, then the electronic cigarette displays the temperature selection interface and enters the standby mode. If an adjustment signal is detected during displaying the temperature selection interface, adjusting the cursor position in the temperature selection interface according to the adjustment signal, which can be the operation signal generated when the increase key or decrease key on the electronic cigarette is operated. The electronic cigarette automatically takes the temperature selected by the cursor as the temperature selected by the user. The electronic cigarette controls the atomizing head to work according to the cigarette lighting signal, further includes: obtaining the heating rule according to the temperature selected by user and current heating mode of the electronic cigarette, the electronic cigarette controls the atomizing head to work according to the heating rule.

Optionally, during displaying the temperature selection interface, if detecting the operation signal generated by pressing the electronic cigarette on/off key, determining the operation signal as the main menu display signal and then displaying the main menu. That is to say, after the electronic cigarette is turned on, the temperature selection interface is displayed. The user can select the temperature by operating the increase key or the decrease key, and entering the main menu by operating the confirmation key.

Optionally, when detecting that the electronic cigarette is not installed the atomizing head, displaying the prompt information to prompt that the atomizing head is not installed, and the displaying prompt information method can be any one of text prompt, voice prompt, animation prompt, etc. For example, displaying the text prompt "No Atomizing Head" in the display screen.

An embodiment of the invention also provides a computer readable storage medium, in which one or more instructions are stored. When the one or more instructions are executed by a processor in the electronic cigarette, the method for controlling the electronic cigarette mentioned in any embodiment is realized.

An embodiment of the invention also provides a device for controlling the electronic cigarette, the device includes: a memory and a processor; at least one program instruction is stored in the memory; the processor is used for executing computer program instructions to perform various processes and methods, and realizes the method for controlling the electronic cigarette in any embodiment by loading and executing the at least one program instruction.

The serial numbers in the embodiments of the present invention are merely for the description, and do not represent the advantages and disadvantages of the embodiments.

A person skilled in the art may understand that all or part of the steps of implementing the above embodiments may be completed by hardware, or may be instructed by a program to instruct related hardware, and the program may be stored in a computer readable storage medium. The storage medium mentioned may be a read only memory, a magnetic disk, an optical disk or the like.

The above are only the preferred embodiments of the present invention, and are not intended to limit the present invention. Any modifications, equivalents, improvements, etc., which are within the spirit and scope of the present invention, should be included in the protection scope of the present invention.

What is claimed is:

1. A method for controlling an electronic cigarette, comprising:

when a safety mode of the electronic cigarette is turned on, if a cigarette lighting signal is detected, using a detection component to detect whether an atomizing head is moved out of an electronic cigarette body;

if detecting that the atomizing head is moved out of the electronic cigarette body, stopping controlling the atomizing head to work according to a cigarette lighting signal, wherein when the atomizing head is moved out of the electronic cigarette body, the atomizing head is still electrically connected to a battery assembly in the electronic cigarette.

2. The method according to claim 1, wherein the atomizing head of the electronic cigarette is arranged on a movable bottom cover, the movable bottom cover is rotationally connected to the electronic cigarette body, when the movable bottom cover is closed, it moves into the electronic cigarette body, when the movable bottom cover is opened, it moves out of the electronic cigarette body, the detection component comprises a hall switch and a magnetic part, wherein, the magnetic part is arranged on the movable bottom cover, and the hall switch is arranged in the electronic cigarette body, when the movable bottom cover drives the atomizing head to move into the electronic cigarette body, the hall switch is located above the magnetic part; or the hall switch is arranged on the movable bottom cover, the magnetic part is arranged in the electronic cigarette body, when the movable bottom cover drives the atomizing head to move into the electronic cigarette body, the magnetic part is located above the hall switch.

3. The method according to claim 1, further comprises:

when the electronic cigarette is in a standby state and a main menu display signal is detected, displaying a main menu, which comprises a safety mode menu item;

when the safety mode menu item is detected to be selected, displaying a first setting interface for setting a switch state in a safety mode.

4. The method according to claim 3, before the step of displaying the main menu, further comprises:

after the electronic cigarette is turned on, entering a standby mode and displaying a temperature selection interface;

if an adjustment signal is detected during displaying the temperature selection interface, obtaining a selected temperature in the temperature selection interface according to the adjustment signal, which can be an operation signal generated when an increase key or a decrease key on the electronic cigarette is operated;

during displaying the temperature selection interface, if detecting the main menu display signal generated by operating an electronic cigarette on/off key, implementing the step of displaying the main menu.

5. The method according to claim 3, wherein the main menu also comprises at least one of heating mode menu item, temperature measurement unit menu item and screen brightness menu item, the method further comprises:

when detecting that the heating mode menu item is selected, displaying a mode selection interface for selecting a heating mode, which comprises the heating mode matched with at least one type of atomizing head supported by the electronic cigarette; and/or when detecting that the temperature measurement unit menu item is selected, displaying a second setting interface for setting the temperature measurement unit in the electronic cigarette; and/or when detecting that the screen brightness menu item is selected, displaying a third setting interface for setting brightness of the electronic cigarette display screen.

6. The method according to claim 1, further comprises:

when detecting that the atomizing head is changed in the electronic cigarette, the detection component is used to detect whether the atomizing head is moved into the electronic cigarette body;

when detecting that the atomizing head is moved into the electronic cigarette body, displaying the mode selection interface for selecting the heating mode;

obtaining a selected heating mode in the mode selection interface;

the electronic cigarette controlling the atomizing head to work according to the cigarette lighting signal, comprises: the electronic cigarette controlling the atomizing head to work according to a heating rule corresponding to the selected heating mode.

7. The method according to claim 6, after the step of obtaining the selected heating mode in the mode selection interface, further comprises:

displaying the temperature selection interface to obtain the selected heating temperature;

the electronic cigarette controlling the atomizing head to work according to the heating rule corresponding to the selected heating mode, comprises: obtaining the heating rule according to the selected heating mode and the selected heating temperature, and the electronic cigarette controlling the atomizing head to work according to the heating rule.

8. The method according to claim 1, after the step of using the detection component to detect whether the atomizing head is moved out of the electronic cigarette body, further comprises:

if detecting that the atomizing head is moved out of the electronic cigarette body, obtaining reference information, which comprises at least one of time interval from end time of previous cigarette lighting operation, temperature of the atomizing head, and resistance value of the atomizing head;

if determining existing scalding risk according to the reference information, displaying prompt information to prompt the existing scalding risk.

9. A computer readable storage medium having stored therein one or more instructions, wherein when the one or more instructions are executed by a processor in an electronic cigarette, the method for controlling the electronic cigarette according to claim 1 is implemented.

10. The computer readable storage medium according to claim 9, wherein the atomizing head of the electronic cigarette is arranged on a movable bottom cover, the movable bottom cover is rotationally connected to the electronic cigarette body, when the movable bottom cover is closed, it moves into the electronic cigarette body, when the movable bottom cover is opened, it moves out of the electronic cigarette body, the detection component comprises a hall switch and a magnetic part, wherein, the magnetic part is arranged on the movable bottom cover, and the hall switch is arranged in the electronic cigarette body, when the movable bottom cover drives the atomizing head to move into the electronic cigarette body, the hall switch is located above the magnetic part; or the hall switch is arranged on the movable bottom cover, the magnetic part is arranged in the electronic cigarette body, when the movable bottom cover drives the atomizing head to move into the electronic cigarette body, the magnetic part is located above the hall switch.

11. The computer readable storage medium according to claim 9, further comprises:

when the electronic cigarette is in a standby state and a main menu display signal is detected, displaying a main menu, which comprises a safety mode menu item;

when the safety mode menu item is detected to be selected, displaying a first setting interface for setting a switch state in a safety mode.

12. The computer readable storage medium according to claim 11, before the step of displaying the main menu, further comprises:

after the electronic cigarette is turned on, entering a standby mode and displaying a temperature selection interface;

if an adjustment signal is detected during displaying the temperature selection interface, obtaining a selected temperature in the temperature selection interface according to the adjustment signal, which can be an operation signal generated when an increase key or a decrease key on the electronic cigarette is operated;

during displaying the temperature selection interface, if detecting the main menu display signal generated by operating a electronic cigarette on/off key, implementing the step of displaying the main menu.

13. The computer readable storage medium according to claim 11, wherein the main menu also comprises at least one of heating mode menu item, temperature measurement unit menu item and screen brightness menu item, the method further comprises:

when detecting that the heating mode menu item is selected, displaying a mode selection interface for selecting a heating mode, which comprises the heating mode matched with at least one type of atomizing head supported by the electronic cigarette; and/or when detecting that the temperature measurement unit menu item is selected, displaying a second setting interface for setting the temperature measurement unit in the electronic cigarette; and/or when detecting that the screen brightness menu item is selected, displaying a third setting interface for setting brightness of the electronic cigarette display screen.

14. The computer readable storage medium according to claim 9, further comprises:

when detecting that the atomizing head is changed in the electronic cigarette, the detection component is used to detect whether the atomizing head is moved into the electronic cigarette body;

when detecting that the atomizing head is moved into the electronic cigarette body, displaying the mode selection interface for selecting the heating mode;

obtaining a selected heating mode in the mode selection interface;

the electronic cigarette controlling the atomizing head to work according to the cigarette lighting signal, comprises: the electronic cigarette controlling the atomizing head to work according to a heating rule corresponding to the selected heating mode.

15. The computer readable storage medium according to claim 14, after the step of obtaining the selected heating mode in the mode selection interface, further comprises:

displaying the temperature selection interface to obtain the selected heating temperature;

the electronic cigarette controlling the atomizing head to work according to the heating rule corresponding to the selected heating mode, comprises: obtaining the heating rule according to the selected heating mode and the selected heating temperature, and the electronic cigarette controlling the atomizing head to work according to the heating rule.

16. The computer readable storage medium according to claim 9, after the step of using the detection component to detect whether the atomizing head is moved out of the electronic cigarette body, further comprises:

if detecting that the atomizing head is moved out of the electronic cigarette body, obtaining reference information, which comprises at least one of time interval from end time of previous cigarette lighting operation, temperature of the atomizing head, and resistance value of the atomizing head;

if determining existing scalding risk according to the reference information, displaying prompt information to prompt the existing scalding risk.

17. A device for controlling an electronic cigarette, comprising:

a memory and a processor;

the memory storing at least one program instruction;

the processor loading and executing the at least one program instruction to implement the method for controlling the electronic cigarette according to claim 1.

18. The device according to claim 17, wherein the atomizing head of the electronic cigarette is arranged on the movable bottom cover, the movable bottom cover is rotationally connected to the electronic cigarette body, when the movable bottom cover is closed, it moves into the electronic cigarette body, when the movable bottom cover is opened, it moves out of the electronic cigarette body, the detection component comprises a hall switch and a magnetic part, wherein, the magnetic part is arranged on the movable bottom cover, and the hall switch is arranged in the electronic cigarette body, when the movable bottom cover drives the atomizing head to move into the electronic cigarette body, the hall switch is located above the magnetic part; or the hall switch is arranged on the movable bottom cover, the magnetic part is arranged in the electronic cigarette body, when the movable bottom cover drives the atomizing head to move into the electronic cigarette body, the magnetic part is located above the hall switch.

19. The device according to claim 17, further comprises:

when the electronic cigarette is in a standby state and a main menu display signal is detected, displaying a main menu, which comprises a safety mode menu item;

when the safety mode menu item is detected to be selected, displaying a first setting interface for setting a switch state in a safety mode.

20. The device according to claim 19, before the step of displaying the main menu, further comprises:

after the electronic cigarette is turned on, entering a standby mode and displaying a temperature selection interface;

if an adjustment signal is detected during displaying the temperature selection interface, obtaining a selected temperature in the temperature selection interface according to the adjustment signal, which can be an operation signal generated when an increase key or a decrease key on the electronic cigarette is operated;

during displaying the temperature selection interface, if detecting the main menu display signal generated by operating a electronic cigarette on/off key, implementing the step of displaying the main menu.

* * * * *